US006824400B2

(12) United States Patent
Kashio

(10) Patent No.: US 6,824,400 B2
(45) Date of Patent: Nov. 30, 2004

(54) SURFACE MOUNT CONNECTOR

(75) Inventor: Kinji Kashio, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 10/652,196

(22) Filed: Sep. 2, 2003

(65) Prior Publication Data

US 2004/0053521 A1 Mar. 18, 2004

(30) Foreign Application Priority Data

Sep. 12, 2002 (JP) ..... 2002-266676

(51) Int. Cl.[7] ..... H01R 1/00
(52) U.S. Cl. ..... 439/83
(58) Field of Search ..... 439/83, 74, 660

(56) References Cited

U.S. PATENT DOCUMENTS 5,116,247 A * 5/1992 Enomoto et al. ..... 439/660
5,498,167 A * 3/1996 Seto et al. ..... 439/74

FOREIGN PATENT DOCUMENTS

JP 5-283131 10/1993

* cited by examiner

*Primary Examiner*—Phuong Dinh
(74) *Attorney, Agent, or Firm*—Wenderoth, Lind & Ponack, L.L.P.

(57) ABSTRACT

A surface mount connector whose male or female part is to be mounted onto a printed circuit board having conductor pads on its surface so arranged in two lines on either side of a given midline that the first line of conductor pads is closer to the midline than the second line of conductor pads, and that the conductor pads of the first line are staggered with those of the second line on each side. The male or female part comprises an insulating housing and male or female contact pieces mounted to the insulating housing in two lines, symmetrically relative to the midline of the housing. Each male or female contact piece has two lead projections so placed apart from each other that the lead projections may be put in contact with the conductor pads of the first and second lines when the male or female part is mounted onto the printed circuit board.

4 Claims, 7 Drawing Sheets

SURFACE MOUNT CONNECTOR

BACKGROUND OF THE INVENTION

1. Field of the Invention

The present invention relates to a surface mount connector to be mounted onto a printed circuit board having conductor pads staggered on its surface.

2. Related Art

A surface mount connector comprises male and female parts, each being so designed as to be mounted onto a printed circuit board whose conductor pads are staggered on its surface for high-density mount. Referring FIG. 5, for example, two lines of conductor pads 13 and 14 are arranged on each side of the midline "c". One of the two lines of conductor pads is closer to the midline "c" than the other line; the pads 14 are apart from the midline "c" by the short distance "a", and are staggered with the pads 13, which are apart from the midline "c" by the long distance "b". The long-distant pads 13 arranged on the opposite sides are symmetric with respect to the mid line "c", and likewise, the short-distant pads 14 arranged on the opposite sides are symmetric with respect to the mid line "c". The pads 13 and 14 may be arranged asymmetrically on the opposite sides with respect to the mid line "c".

Referring to FIGS. 6(A) and 6(B), the male part uses two kinds of contact pieces 15*a* and 15*b*. The first kind of contact piece 15*a* has a lead projection formed on its horizontal base, the lead projection being apart from its upright male contact arm. Specifically the lead projection is so placed on the bottom of the horizontal base that it may be apart from the midline "c" by the long distances "b", thereby permitting it to confront a selected conductor pad 13 when the male part is mounted on to the printed circuit board 11. Likewise, the second kind of contact piece 15*b* has a lead projection formed on its horizontal base, the lead projection being close to its upright male contact arm. Specifically the lead projection is so placed on the bottom of the horizontal base that it may be apart from the midline "c" by the short distances "a", thereby permitting it to confront a selected conductor pad 14 when the male part is mounted on to the printed circuit board 11.

Similarly the female part uses two kinds of contact pieces 16*a* and 16*b* as shown in FIGS. 7(A) and 7(B). These different contact pieces are different only in respect of whether their lead projections are close to or remote from their upright contact arms. Such a conventional surface mount connector (stacking connector) is disclosed in JP 5-283131(A), particularly FIG. 1.

The conventional surface mount connector uses two different contact pieces to be mounted in each of the male and female parts. This causes significant disadvantage, which would not be caused if the male or female part used one and same contact piece; first, the number of parts to be assembled increases, and second, two different contact pieces need to be carefully distinguished and inserted alternately into contact slots of the housing. Apparently this is tedious work.

One object of the present invention is to provide a surface mount connector whose male or female part uses one and same kind of contact pieces.

SUMMARY OF THE INVENTION

To attain this object a surface mount connector whose male or female part is to be mounted onto a printed circuit board having conductor pads on its surface, these conductor pads being so arranged in two lines on each side of a given midline that the first line of conductor pads is closer to the midline than the second line of conductor pads, and that the conductor pads of the first line are staggered with those of the second line on each side, is improved according to the present invention in that each of the male or female part comprises an insulating housing and a plurality of male or female contact pieces mounted to the insulating housing in two lines, symmetrically relative to the midline of the housing, each male or female contact piece having two lead projections so placed apart from each other that the lead projections may be put in contact with the conductor pads of the first and second lines when the male or female part is mounted onto the printed circuit board.

Each male or female contact piece has two lead projections, and these lead projections are so placed apart from each other on the horizontal base bottom of the contact piece that either one may be put in contact with the conductor pad of the first or second line on the printed circuit board. Male or female contact pieces are punched into one and same shape and size. Also advantageously, use of one and same male or female contact pieces facilitates the mounting of contact pieces to the housing; it is not required that contact pieces are distinguished in respect of their shapes when inserting them into the contact slots of the housing.

Other objects and advantages of the present invention will be understood from the following description of a surface mount connector according to one embodiment of the present invention, which is shown in accompanying drawings.

DETAILED DESCRIPTION OF PREFERRED EMBODIMENT

Figure 5:
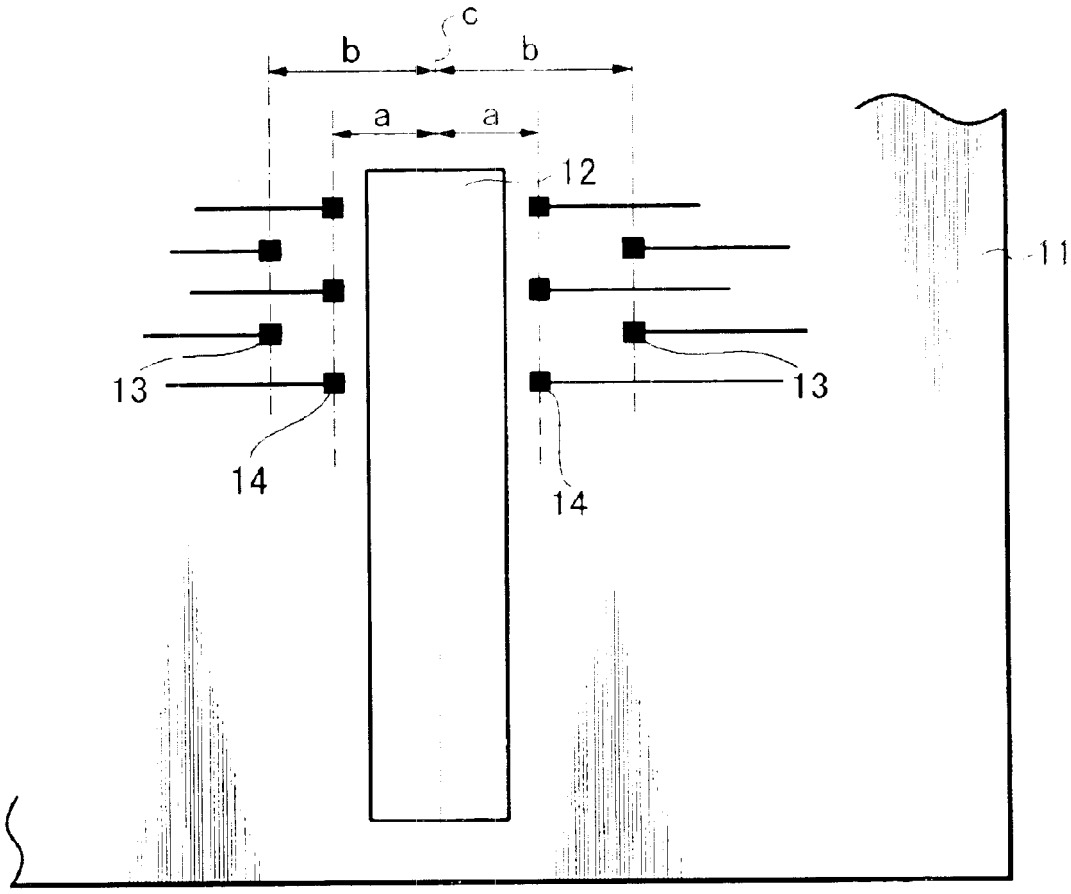
FIG. 5 is a plane view of a printed circuit board illustrating the conductor pads staggered on its surface.
Figure 6A:
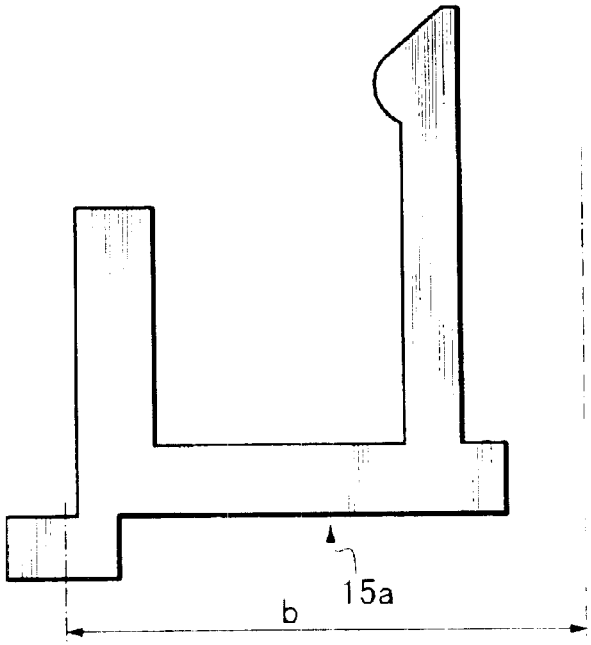
Fig. 6(A) PRIOR ART
FIG. 6 shows male pieces mounted to the male part of a conventional connector.
Figure 6B:
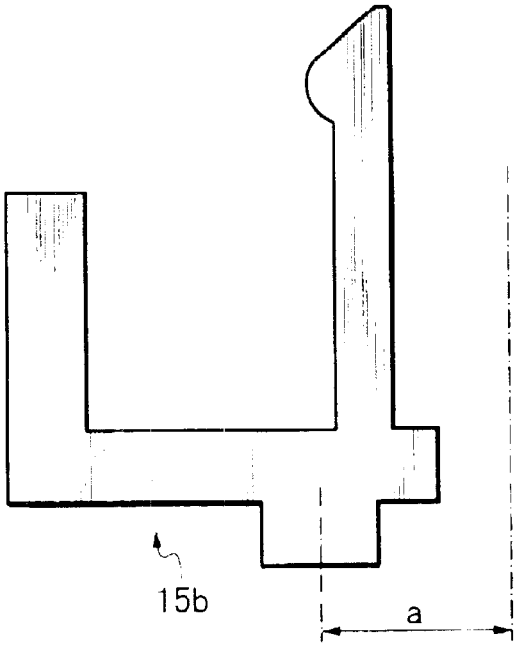
Fig. 6(B) PRIOR ART
Figure 7A:
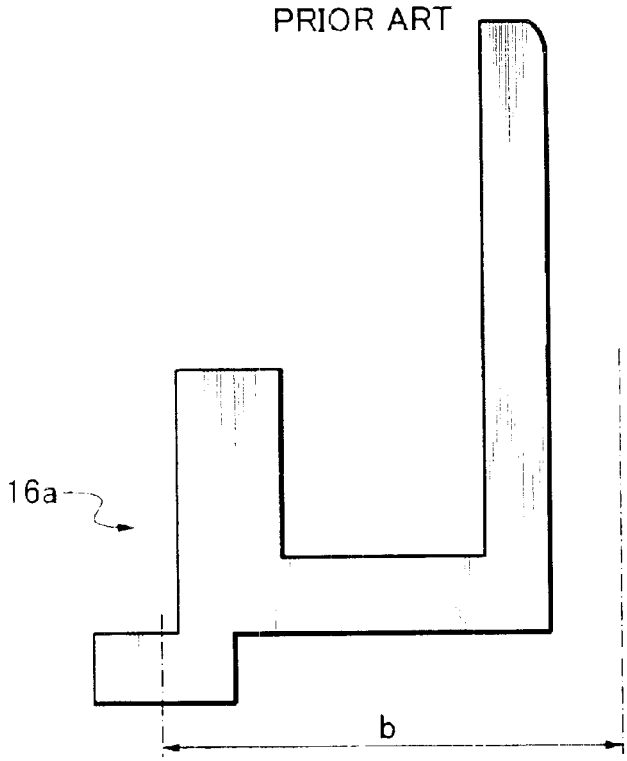
Fig. 7(A) PRIOR ART
FIG. 7 shows female pieces mounted to the female part of the conventional connector.
Figure 7B:
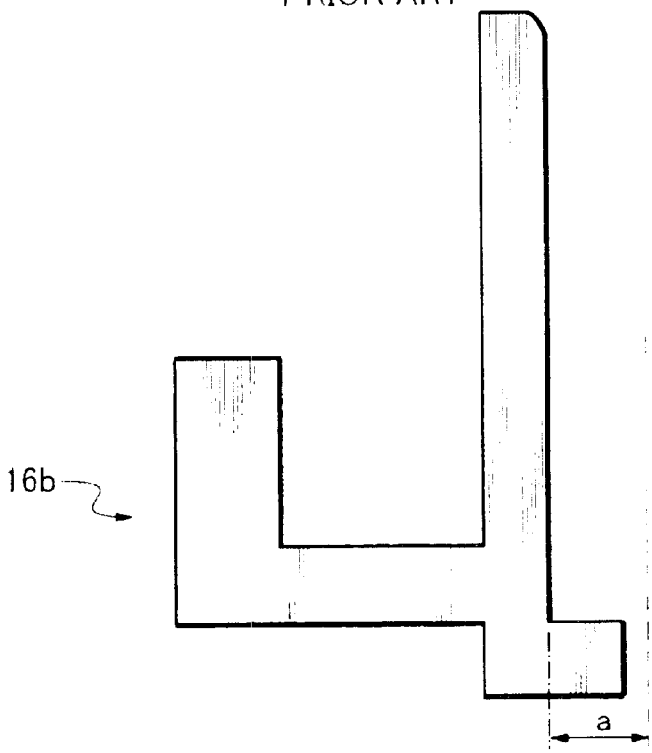
Fig. 7(B) PRIOR ART

A surface mount connector is composed of male and female parts, which the male part or the female part is to be mounted onto a printed circuit board. The printed circuit board has conductor pads on its surface, for example, as shown in FIG. 5. The pads 13 and 14 may be arranged asymmetrically on the opposite sides with respect to the mid line "c".

Figure 1:
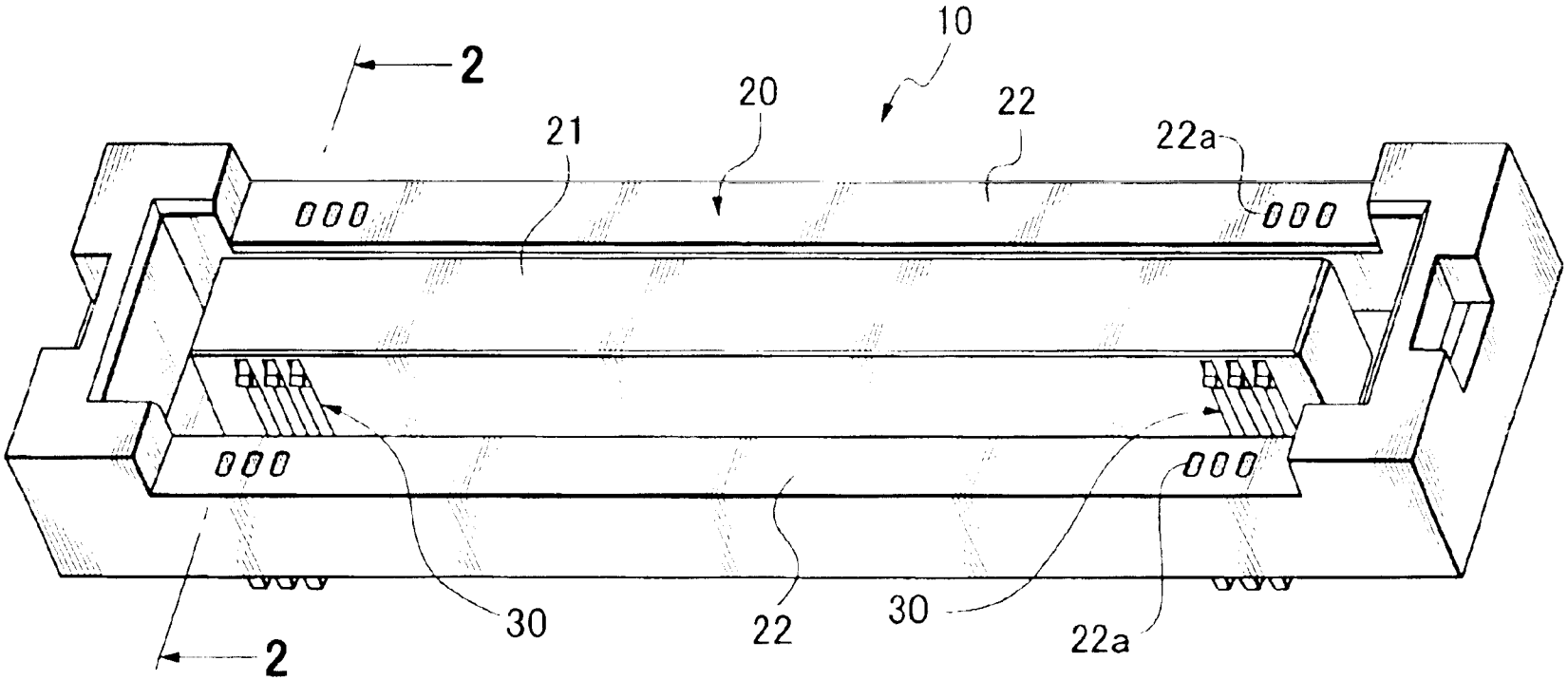
FIG. 1 is a perspective view of the male part of a surface mount connector according to the present invention.
Figure 2:
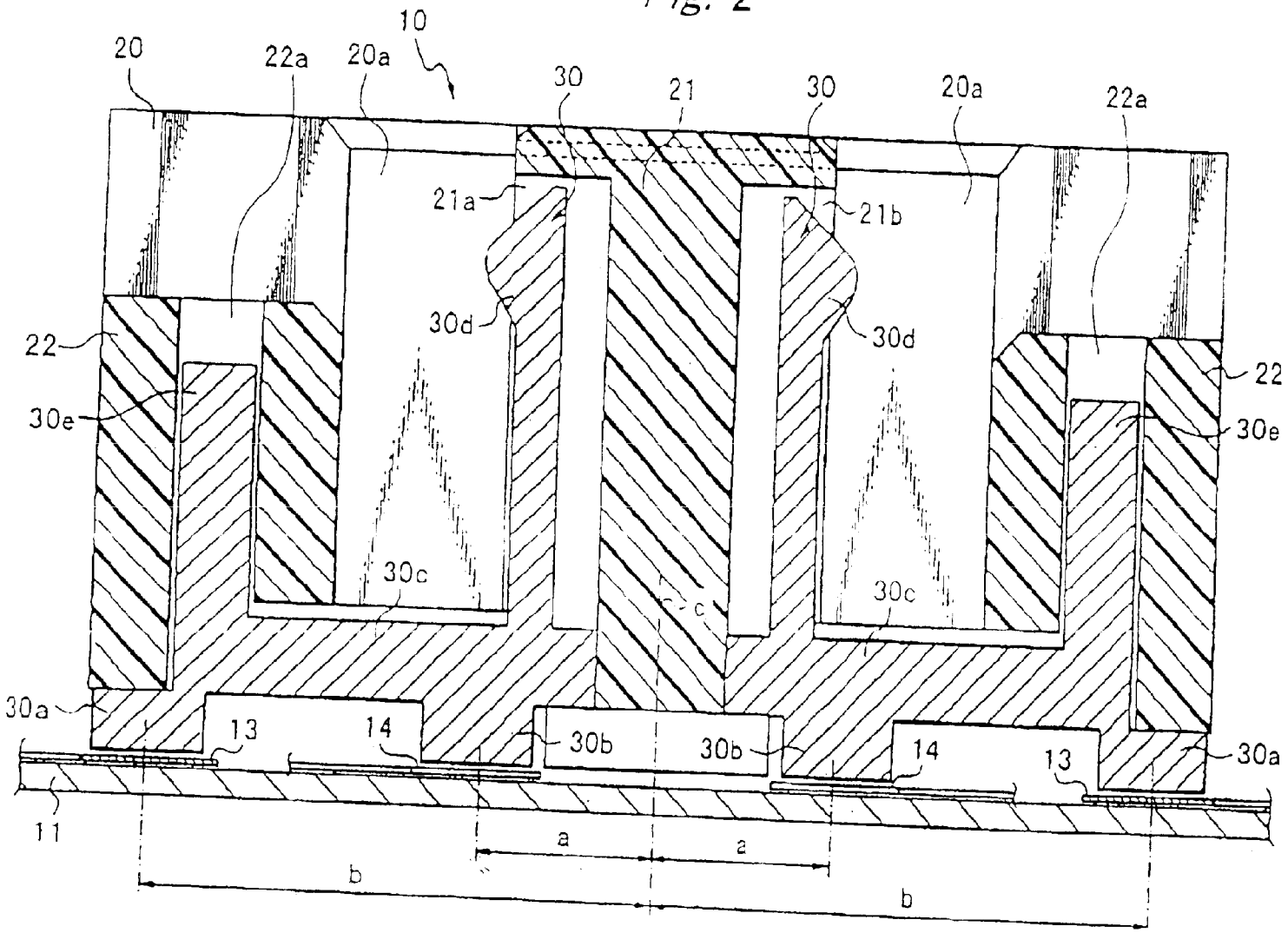
FIG. 2 is a cross section of the male part taken along the line 2—2 in FIG. 1.

Referring to FIGS. 1 and 2, the male part 10 comprises an elongated insulating housing 20 and a plurality of male contact pieces 30. The insulating housing 20 comprises a trough-like body and a mid-wall 21 standing upright on the bottom of the trough-like body, thus defining two elongated hollow spaces 20*a* on the opposite sides of the mid-wall 21. Each side wall 22 of the trough-like body has contact holes

22*a* made at regular intervals, whereas the mid-wall 21 has vertical slots 21*a* and 21*b* made on its opposite sides in confronting relation with the contact holes 22*a*. The male contact pieces 30 are mounted to the insulating housing 20 in two lines by inserting into the contact holes 22*a* and vertical slots 21*a* or 21*b* of the trough-like body. Thus, two parallel linear arrangements of male contact pieces 30 are symmetrical relative to the mid-wall 21 of the housing 20.

As seen from FIG. 2, each male contact piece 30 comprises a horizontal base 30*c* having two lead projections 30*a* and 30*b* integrally connected to its bottom surface, an upright mount arm 30*e* integrally connected to the horizontal base close to one end of the horizontal base 30*c*, and an upright contact arm 30*d* integrally connected to the horizontal base close to the other end of the horizontal base 30*c*. Each male contact piece 30 is fixed to the male part 10 with its contact arm 30*d* and mount arm 30*e* inserted into the selected slot 21*a* or 21*b* and contact hole 22*a*, allowing its contact 30*d* to be exposed on one or the other side of the mid-wall 21 of the insulating housing 20. It should be noted that the lead projections 30*a* and 30*b* are so placed apart from each other on the bottom surface of the horizontal base 30*c* that one of the lead projection 30*a* and 30*b* may be put in contact with a selected long-distant conductor pad 13 or short-distant conductor pad 14 on the printed circuit board 11 when the male part 10 is aligned with the midline "c" of the conductor pad arrangement (see FIG. 5), and is mounted onto the printed circuit board 11. The male part 10 is fixed to the printed circuit board 11 by soldering the lead projections 30*a* and the confronting long-distant conductor pads 13, and by soldering the lead projections 30*b* and the confronting short-distant conductor pads 14.

As described above, one male contact 30 has two lead projections 30*a* and 30*b*, and in case one lead projection 30*a* is soldered to 13, the other projection 30*b* is not soldered and therefore the projection 30*b* may not be electrically conducted with the pad 14.

Figure 3:
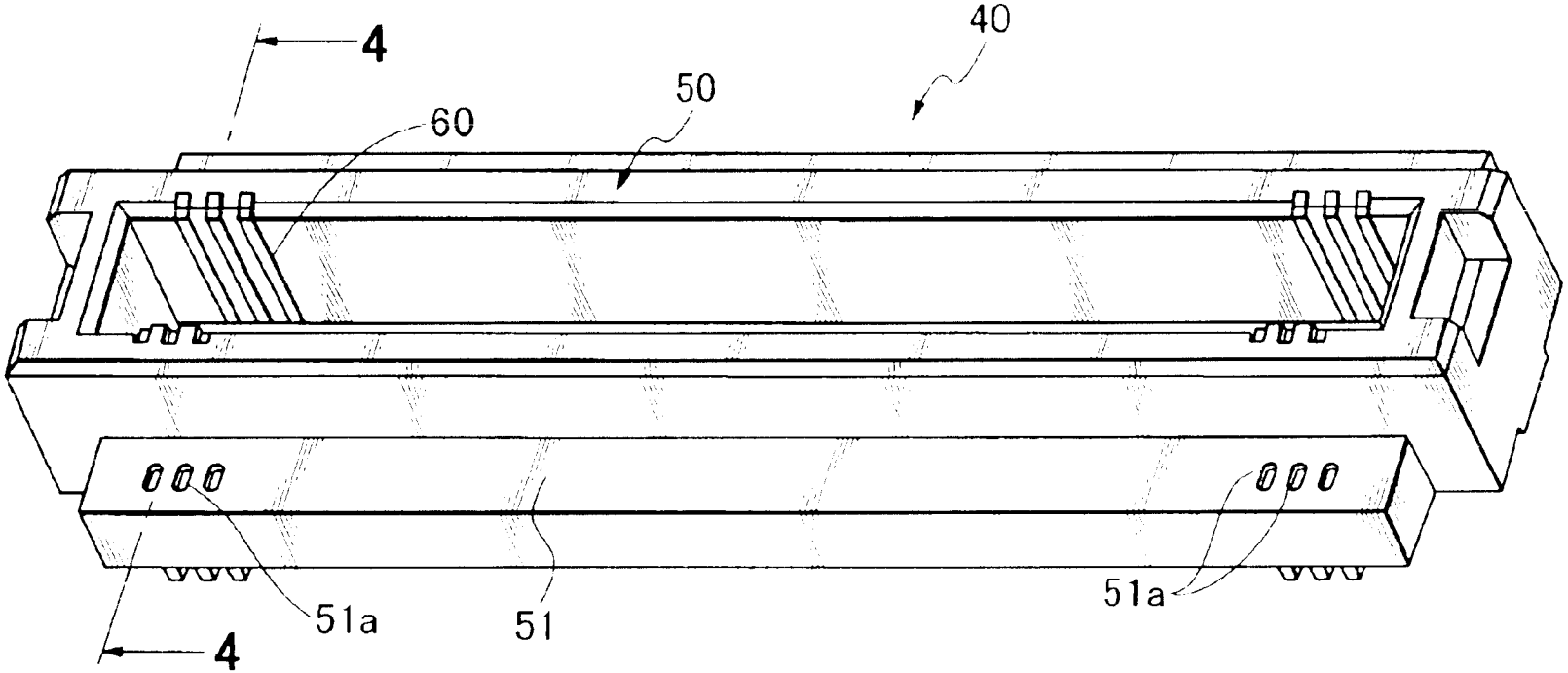
FIG. 3 is a perspective view of the female part of the surface mount connector.
Figure 4:
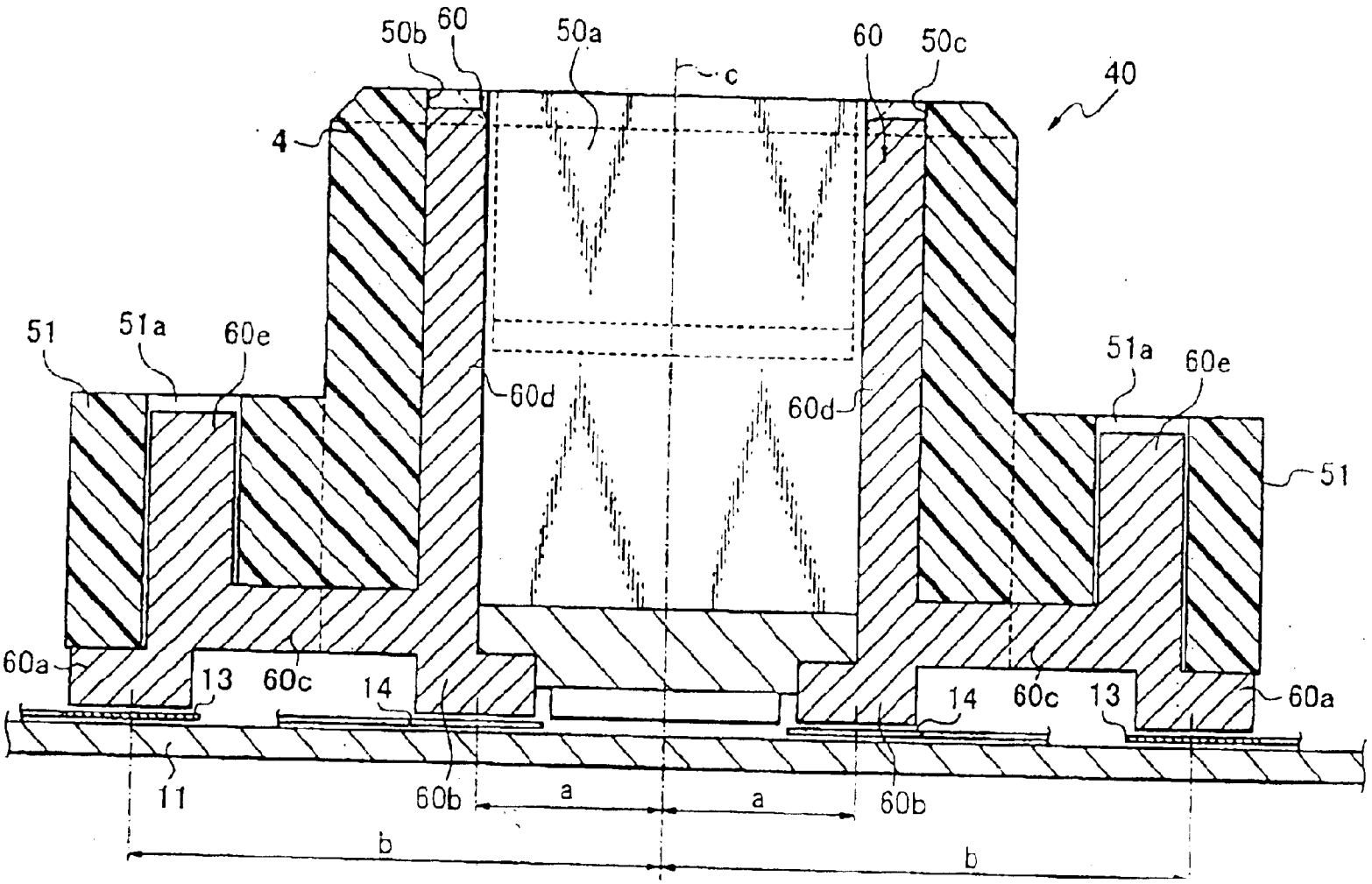
FIG. 4 is a cross section of the female part taken along the line 4—4 in FIG. 3.

Referring to FIGS. 3 and 4, the female part 40 comprises an elongated insulating housing 50 and a plurality of female contact pieces 60. The insulating housing 50 comprises a trough-like body to allow insertion of the mid-wall 21 of the male part 10. Each protruding rim 51 has contact holes 51*a* made at regular intervals, whereas each opposite, inner wall of the trough-like hollow space 50*a* has vertical slots 50*b* and 50*c* made in confronting relation with the contact holes 51*a* in each protruding rim 51. The female contact pieces 60 are mounted to the insulating housing 50 in two lines by inserting into the contact holes 51*a* and vertical slots 50*b* or 50*c* of the trough-like body. Thus, two parallel linear arrangements of female contact pieces 60 are symmetrical relative to the midline "c" of the housing 50.

As seen from FIG. 4, each female contact piece 60 comprises a horizontal base 60*c* having two lead projections 60*a* and 60*b* integrally connected to its bottom surface, an upright mount arm 60*e* integrally connected to the horizontal base 60*c* close to one end of the horizontal base, and an upright contact arm 60*d* integrally connected to the horizontal base close to the other end thereof. Each female contact piece 60 is fixed to the housing 50 with its contact arm 60*d* and mount arm 60*e* inserted into the selected slot 50*b* or 50*c* and contact hole 51*a*, allowing its contact 60*d* to be exposed on one or the other inner wall of the insulating housing 50. The lead projections 60*a*, 60*b* are so placed apart from each other on the horizontal base 60*c* that one of the lead projections 60*a* and 60*b* may be put in contact with a selected conductor pad 13 or 14 when the female part 40 is aligned with the midline "c" of the conductor pad arrangement, and is mounted onto the other printed circuit board 11. The female part 40 is fixed to the printed circuit board 11 by soldering the lead projections 60*a*, 60*b* and the confronting conductor pads 13, 14.

In case the surface mount connector is used as stacking connector, the male and female parts 10 and 40 can be combined as a whole by inserting the mid-wall 21 of the male part 10 into the hollow space 50*a* of the female part 40, thereby mating the male and female contacts 30 and 60 together to make a required electric connection between the circuits of the overlying and underlying printed circuit boards stacked together.

I claim:

1. A surface mount connector including a male part and a female part to be mounted onto respective printed circuit boards so that the printed circuit boards can be connected by mating said male part and said female part together, each printed circuit board having conductor pads on a surface thereof, the conductor pads being arranged in two lines on each side of a given midline so that the first line of the conductor pads is closer to the midline than the second line of the conductor pads on each side of the midline, and so that the conductor pads of the first line are staggered with respect to those of the second line on each side of the midline, wherein:

said male part comprises an insulating housing and a plurality of male contact pieces which are mounted to said insulating housing in two lines so as to be symmetrically arranged relative to a midline of said insulating housing, each of said plurality of male contact pieces having two lead projections placed apart from each other so that the lead projections may be put into contact with conductor pads of the first and second lines when said male part is mounted on a respective one of the printed circuit boards, wherein some of said male contact pieces are positioned to have first lead projections of said two lead projections in contact with the conductor pads of the first line and second lead projections of said two lead projections out of contact with any of the conductor pads, and others of the male contact pieces are positioned so as to have second lead projections of said two lead projections in contact with the conductor pads of the second line and have first lead projections of said two lead projections out of contact with any of the conductor pads; and said female part comprises a second insulating housing and a plurality of female contact pieces which are mounted to said second insulating housing in two lines so as to be symmetrically arranged relative to a midline of said second insulating housing, each of said plurality of female contact pieces having two lead projections placed apart from each other so that the lead projections may be put into contact with conductor pads of the first and second lines when said female part is mounted on a respective one of the printed circuit boards, wherein some of said female contact pieces are positioned to have first lead projections of said two lead projections in contact with the conductor pads of the first line and second lead projections of said two lead projections out of contact with any of the conductor pads, and others of the female contact pieces are positioned so as to have second lead projections of said two lead projections in contact with the conductor pads of the second line and have first lead projections of said two lead projections out of contact with any of the conductor pads.

2. The connector of claim 1, wherein said male part has only male contact pieces and said female part has only female contact pieces.

3. A surface mount connector and circuit board arrangement comprising:

printed circuit boards to be connected, each printed circuit board having conductor pads on a surface thereof, the conductor pads being arranged in two lines on each side of a given midline so that the first line of the conductor pads is closer to the midline than the second line of the conductor pads on each side of the midline, and so that the conductor pads of the first line are staggered with respect to those of the second line on each side of the midline; and a surface mount connector including a male part and a female part mounted onto respective said printed circuit boards so that said printed circuit boards can be connected by mating said male part and said female part together, wherein:

said male part comprises an insulating housing and a plurality of male contact pieces which are mounted to said insulating housing in two lines so as to be symmetrically arranged relative to a midline of said insulating housing, each of said plurality of male contact pieces having two lead projections placed apart from each other so that one of the lead projections is in contact with conductor pads of one of the first and second lines of the one of said respective said printed circuit boards to which said male part is mounted, wherein some of said male contact pieces are positioned to have first lead projections of said two lead projections in contact with the conductor pads of the first line and second lead projections of said two lead projections out of contact with any of the conductor pads, and others of the male contact pieces are positioned so as to have second lead projections of said two lead projections in contact with the conductor pads of the second line and have first lead projections of said two lead projections out of contact with any of the conductor pads; and said female part comprises a second insulating housing and a plurality of female contact pieces which are mounted to said second insulating housing in two lines so as to be symmetrically arranged relative to a midline of said second insulating housing, each of said plurality of female contact pieces having two lead projections placed apart from each other so that one of the lead projections is in contact with conductor pads of one of the first and second lines of the one of said respective said printed circuit boards to which said female part is mounted, wherein some of said female contact pieces are positioned to have first lead projections of said two lead projections in contact with the conductor pads of the first line and second lead projections of said two lead projections out of contact with any of the conductor pads, and others of the female contact pieces are positioned so as to have second lead projections of said two lead projections in contact with the conductor pads of the second line and have first lead projections of said two lead projections out of contact with any of the conductor pads.

4. The connector of claim 3, wherein said male part has only male contact pieces and said female part has only female contact pieces.

* * * * *